US007638009B2

(12) United States Patent
Leung

(10) Patent No.: US 7,638,009 B2
(45) Date of Patent: Dec. 29, 2009

(54) METHOD OF MANUFACTURING CONNECTOR COMPRISING AN ARRAY OF FASTENERS

(75) Inventor: Fung Wing Leung, Hong Kong (CN)

(73) Assignee: Texco Hook & Eye Tape Ltd., Kowloon (HK)

( * ) Notice: Subject to any disclaimer, the term of this patent is extended or adjusted under 35 U.S.C. 154(b) by 2 days.

(21) Appl. No.: 12/075,175

(22) Filed: Mar. 10, 2008

(65) Prior Publication Data

US 2009/0223029 A1 Sep. 10, 2009

(51) Int. Cl.
*B32B 37/00* (2006.01)

(52) U.S. Cl. ..... 156/73.3; 156/73.1; 156/93; 156/200; 156/227; 156/256

(58) Field of Classification Search ..... 156/73.1, 156/73.3, 91, 92, 93, 196, 199, 200, 227, 156/250, 252, 256, 308.2, 308.4
See application file for complete search history.

(56) References Cited

U.S. PATENT DOCUMENTS 3,530,813 A 9/1970 Roseman
4,025,374 A 5/1977 Spindler et al.
4,158,584 A 6/1979 Clarke et al.
4,161,420 A 7/1979 Clarke et al.
4,256,529 A * 3/1981 Clarke et al. ..... 156/515
6,309,489 B1 10/2001 Fildan et al.
6,820,312 B1 * 11/2004 Senn ..... 24/697.2
2002/0068506 A1 6/2002 Devita et al.

* cited by examiner

*Primary Examiner*—James Sells
(74) *Attorney, Agent, or Firm*—Jackson Walker LLP

(57) ABSTRACT

A method of manufacturing a connector by fastening a plurality of the fasteners in an array on a face of a backing sheet and forming an aperture in a first sheet portion for receiving each fastener. Each aperture extends between the opposing first and second surfaces of the first sheet portion. Each fastener is inserted into each respective aperture such that the face of the backing sheet is directed inwardly to lie against the first surface. A second sheet portion is abutted with the second surface and joining the first and second sheet portions such that they are joined along at least two opposing edges common to both the first and second sheet portions. The backing sheet is fixed to the first or second sheet portion and inverting the first and second sheet portions such that the face of the backing sheet is directed outwardly. Each fastener protrudes outwardly from each aperture and the backing sheet lies between the first and second sheet portions.

13 Claims, 13 Drawing Sheets

METHOD OF MANUFACTURING CONNECTOR COMPRISING AN ARRAY OF FASTENERS

FIELD OF THE INVENTION

The present invention relates generally to a connector and to a method of manufacturing the connector. More particularly, although not exclusively, the invention relates to connectors and to a method of manufacturing connectors having fasteners such as hooks and eyes mounted in an array on clothing or textile items.

BACKGROUND TO THE INVENTION

Hook and eye tapes are commonly used in undergarments and brassieres to provide a flexible but firm coupling. In general, an array of hooks is sewn onto a first tape aligned in rows and columns. A complementary array of eyes is sewn into a second tape and by engaging different hooks and eyes a degree of lengthwise adjustment is obtained.

Both the hooks and eyes are typically formed of a stiff metal wire with anchors in a form such as a ring at opposing ends of the wire. A planar side of the hooks and eyes lies against the tape and individual hooks and eyes are sewn to the tape over or adjacent the anchors. The tape may be folded to cover the anchors to prevent snagging and unwanted contact between the anchors and the undergarment wearer's skin. The embedment disadvantageously thickens the tape and gives a rough finishing.

In another method to mask the anchors soft textile cover strips are sewn over the anchors between longitudinally spaced rows of hooks and eyes. Formation and securing of the cover strips requires additional cutting and sewing steps. The additional steps increase the complexity and cost for manufacturing the fastener.

The cover strips, commonly made of nylon tricot, are folded when sewn to the tape in order to hide the rough cutting edges of the cover strips and to mask the anchors properly. The individual layers of cover strips are in overlapping relationship to each other. This increases the overall thickness which aside from detracting from the overall aesthetics of the garment, oftentimes, the outline of the fastener is visible through outer tight fitting garments and provides discomfort to the wearer.

During the manufacturing process, continuous strips of hooks and eyes are severed at intervals to produce the individual tapes. The individual tapes bear sharp edges. As these tapes are commonly sewn to undergarments for coupling, they end up rubbing against the skin of the wearer. To avoid continuous abrasion that would renders the garment uncomfortable to wear. Mechanical grinding may be used to smooth out the sharp edges. However, the smoothened edges may still cause discomfort after prolonged exposure to the wearer. This is especially the case when the undergarment is to support a relatively large passive gravitational mass.

At the high end market, undergarments, lingerie and brassieres are fashion which brings out the figurative beauty of a woman. They are seen as accessories rather than hidden costumes. A wide range of styles of lingerie and brassieres now exists, to be worn in a variety of situations, and with a variety of outergarments. The degree of shaping and coverage varies between styles, functionality and fashion, fabric, and colour, from purely utilitarian to sensual. Hence most of them are an attempt by designers to produce a garment which fulfils a practical role, while being an attractive piece of clothing in itself. Appearance and tactile of the individual tapes may be considered unsatisfactory where the stitches and seams are visible.

It is an object of the present invention to overcome or substantially ameliorate at least one of the above disadvantages or more generally to provide an economical way of producing thin seamless fasteners that are comfortable to wear.

SUMMARY OF THE INVENTION

According to the first aspect of the invention there is provided a method of manufacturing a connector having fasteners, such as hooks or eyes for a hook-and-eye connector, comprising the steps: fastening a plurality of the fasteners in an array on a face of a backing sheet; forming an aperture in a first sheet portion for receiving each fastener, each aperture extending between opposing first and second surfaces of the first sheet portion; inserting each fastener into a respective aperture such that the face of the backing sheet is directed inwardly to lie against the first surface; abutting a second sheet portion with the second surface and joining the first and second sheet portions such that they are joined along at least two opposing edges common to both the first and second sheet portions; fixing the backing sheet to the first or second sheet portion; inverting the first and second sheet portions such that the face of the backing sheet is directed outwardly, each fastener protrudes outwardly from each aperture and the backing sheet lies between the first and second sheet portions.

Preferably, the first and second sheet portions are parts of one sheet joined by a fold elongated transverse to the opposing edges to form a pocket.

Preferably, each fastener was an outer end inserted through the aperture and an inner end fixed to the backing sheet, and during insertion, the backing sheet is folded away from the outer end such that the outer end projects from the backing sheet before being inserted into the aperture.

Preferably, one or more of the at least two opposing edges are joined by thermal bonding or ultrasonic welding Preferably, the apertures are formed into first sheet portion by a cutter that vibrates ultrasonically.

Preferably, the first and second sheet portions are made from a fabric.

Preferably, the first and the second surfaces are thermally bonded.

Preferably, the first sheet portion is made from Elastomeric polyurethane.

Preferably, the plurality of the fasteners is sewn on the face of a continuous strip of backing sheet.

Preferably, the continuous strip of backing sheet having fasteners is segmented at intervals by a cutter ultrasonically vibrated to form individual backing sheet.

Preferably, the connector is a hook.

Preferably, the connector is a eye.

According to the second of the invention there is provided a connector manufactured by a method disclosed above.

According to the third aspect of the invention there is provided a connector for a clothing or textile item, comprising: a backing sheet; a plurality of hook or eye fasteners fixed in a first array to the backing sheet; first and second sheet portions joined along at least two opposing edges common to both the first and second sheet portions, the first sheet portion including a second array of apertures, at least one of the first and second sheet portions fixed to the backing sheet; wherein the backing sheet lies between the first and second sheet portions and each fastener projects from a respective one of the apertures.

BRIEF DESCRIPTION OF THE DRAWINGS

An embodiment of the present invention will now be described by way of example only and with reference to the accompanying drawings in which.

DESCRIPTION OF THE PREFERRED EMBODIMENT

Figure 1:
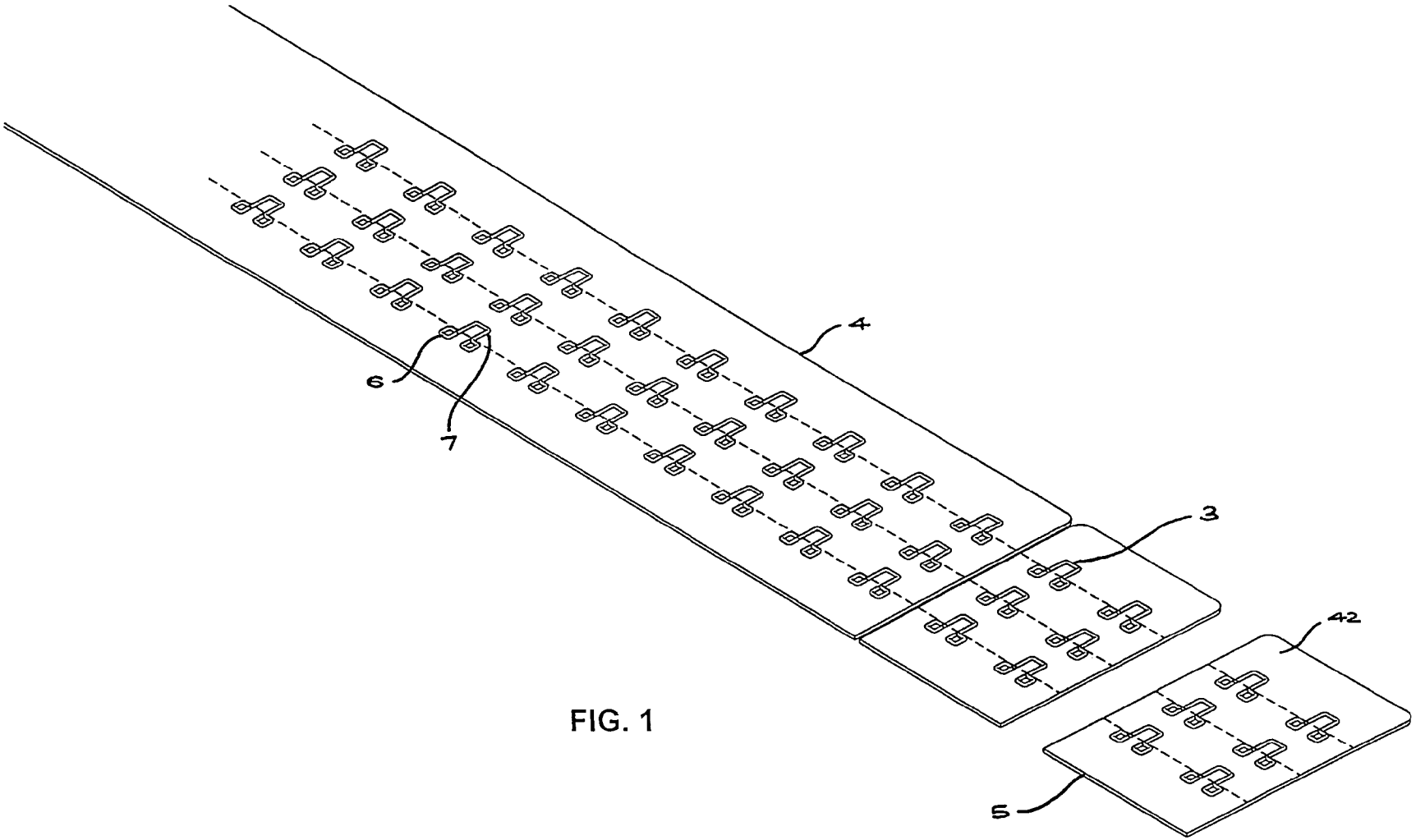
FIG. 1 is a schematic perspective illustration of a continuous tape of backing sheet with arrays of eye fasteners.
Figure 2B:
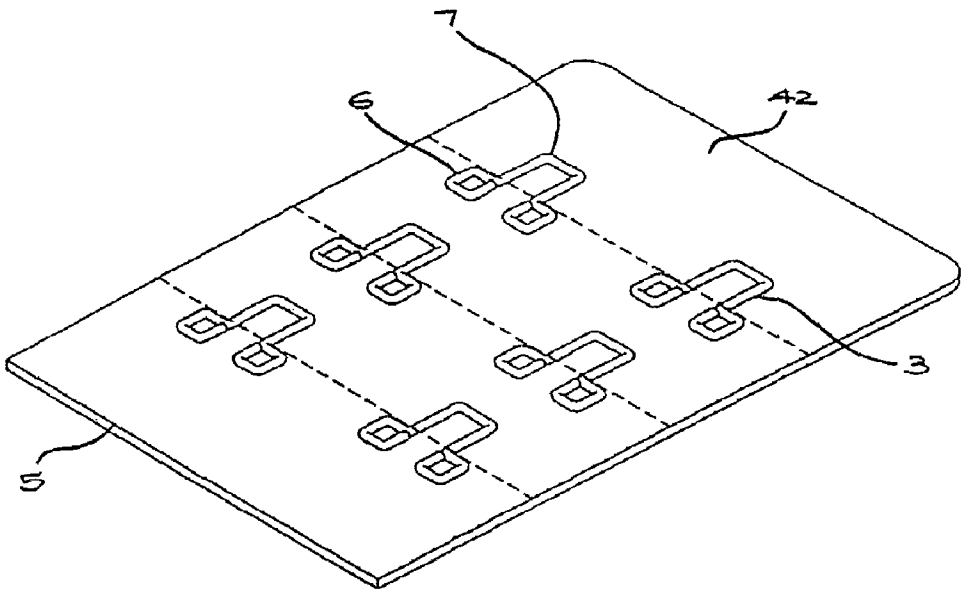
FIG. 2*b* is a schematic perspective illustration of a backing sheet with an array of eye fasteners.
Figure 2A:
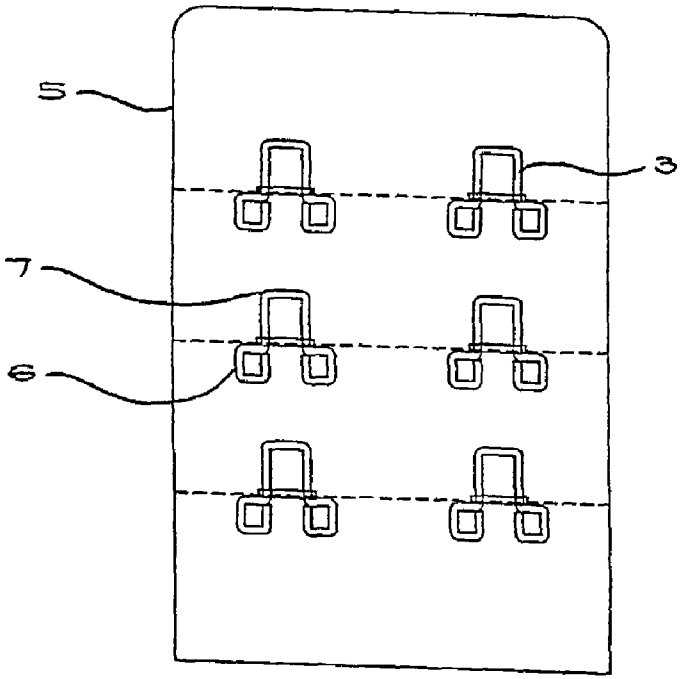
FIG. 2*a* is a schematic top view illustration of the backing sheet with an array of eye fasteners.
Figure 3:
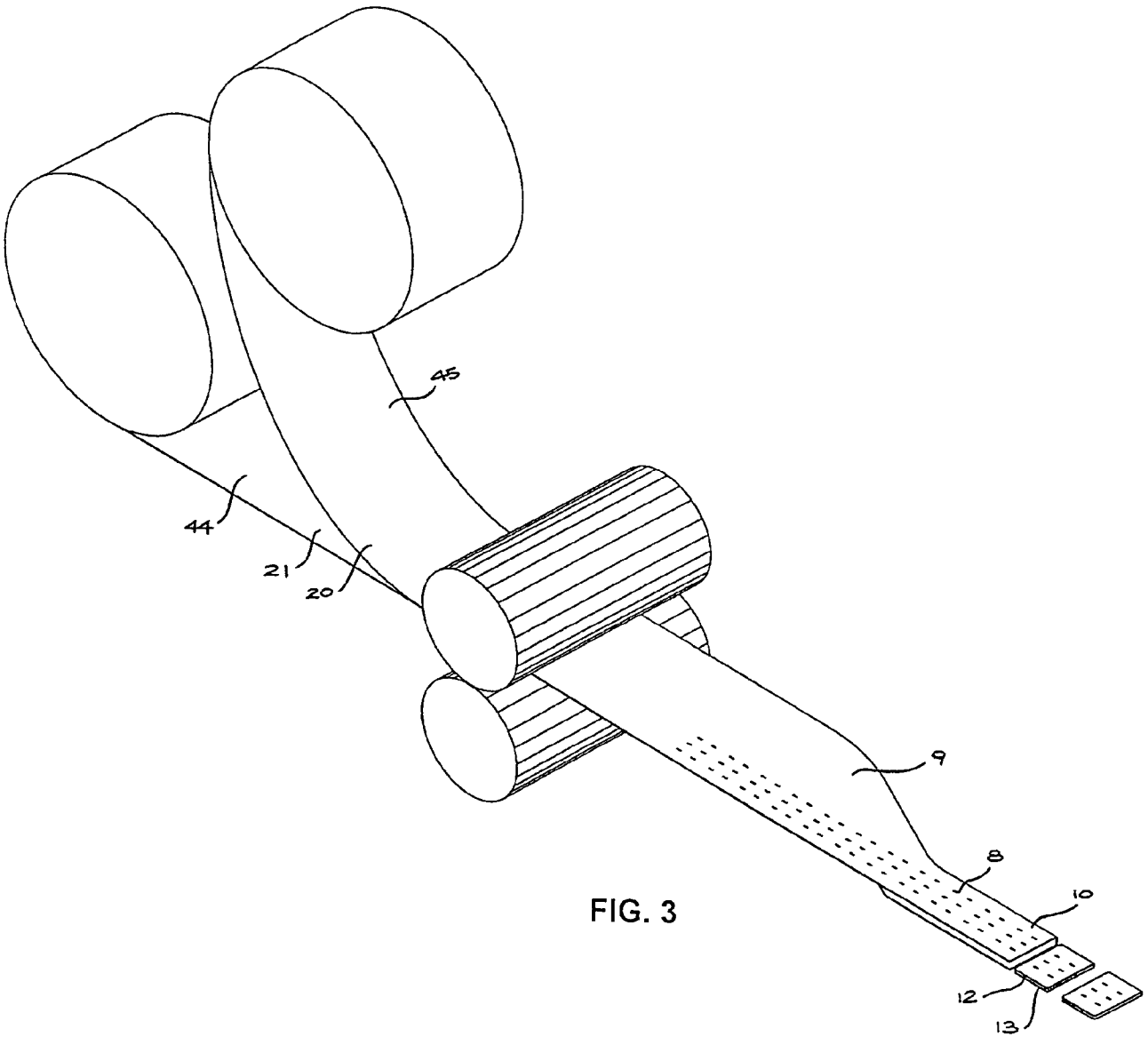
FIG. 3 is a schematic illustration of laminating a first surface with a second surface to form first and second sheet portion of a cover member containing apertures for engaging with the eye fasteners.
Figure 4:
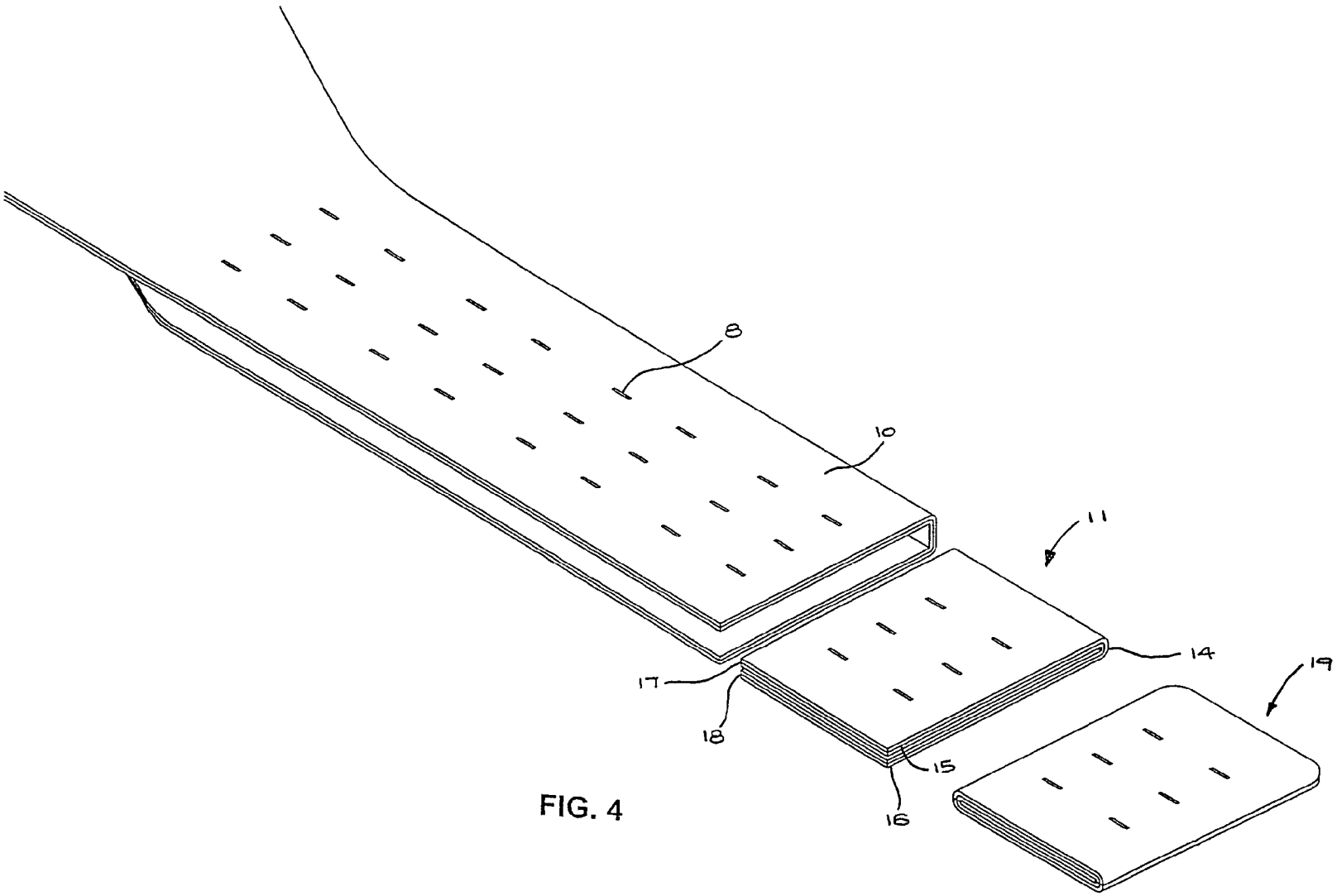
FIG. 4 is a schematic illustration of severing a continuous tape of folded cover member to form individual cover member for eye fasteners.
Figure 5A:
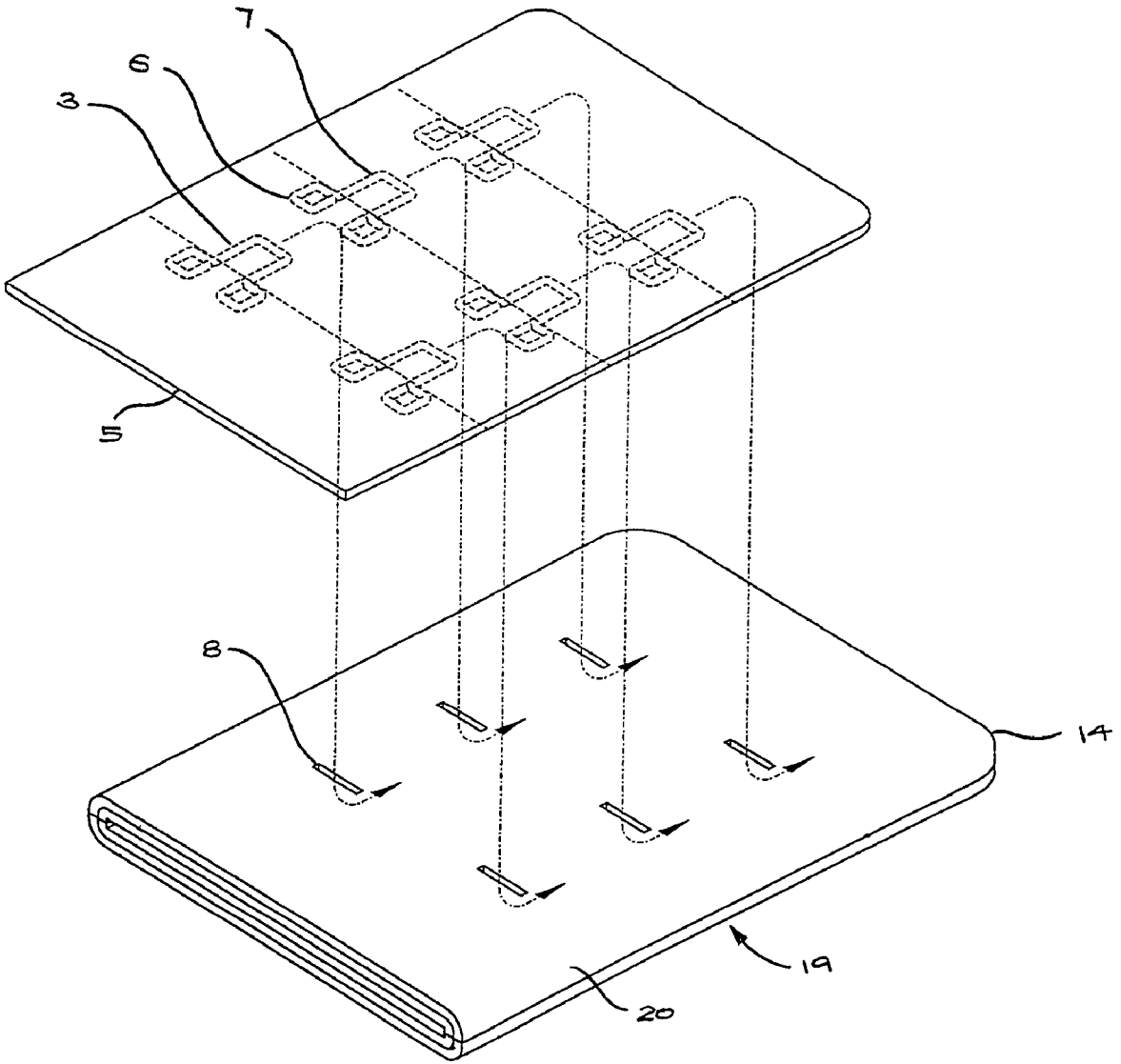
FIG. 5*a* is a schematic perspective illustration of inserting the eye fasteners on the backing sheet into the apertures of the cover member.
Figure 5B:
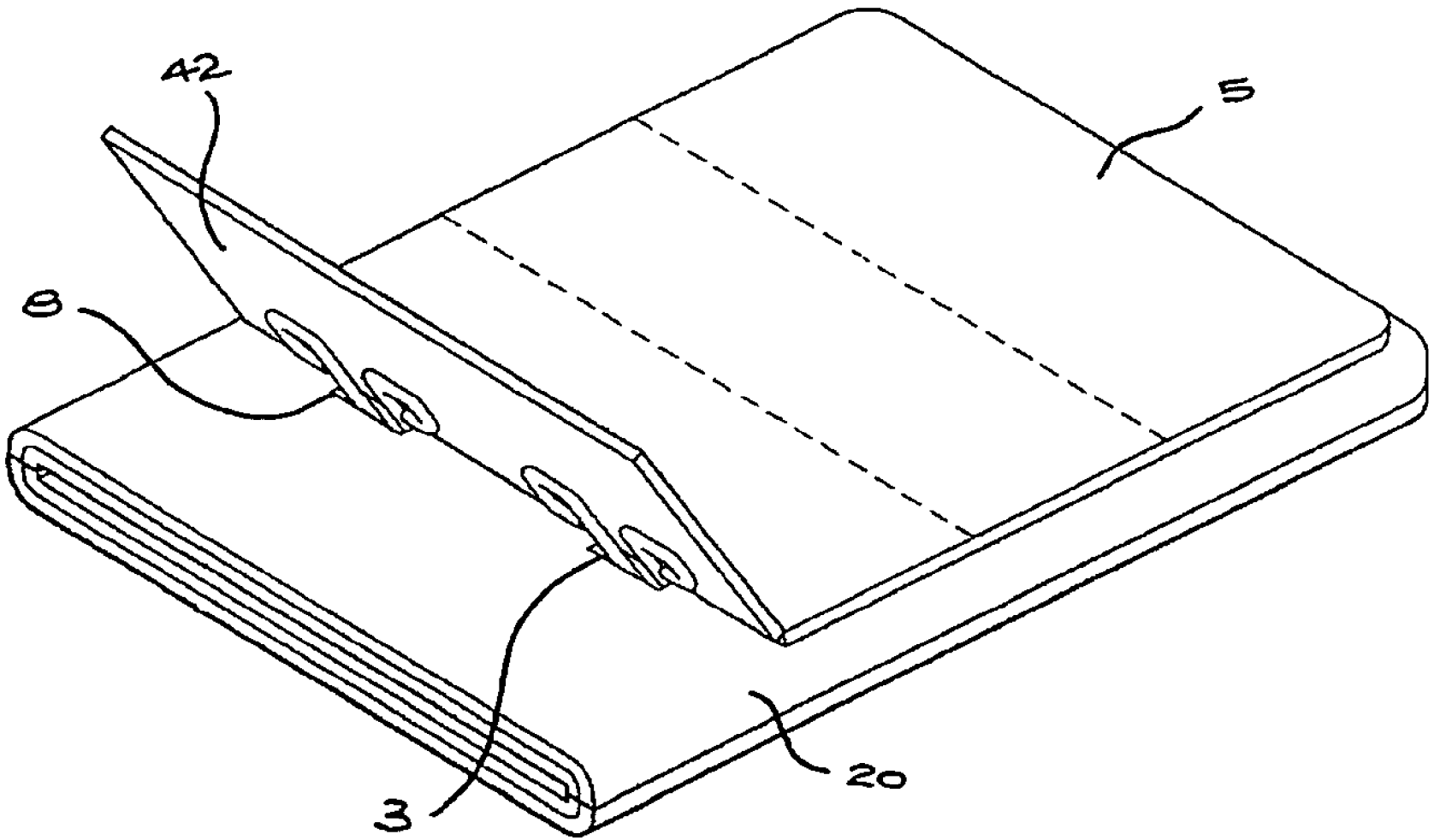
FIG. 5*b* is a schematic perspective illustration of the eye fasteners inserted through the aperture of the cover member by folding the backing sheet away from the outer end of the eye.
Figure 6A:
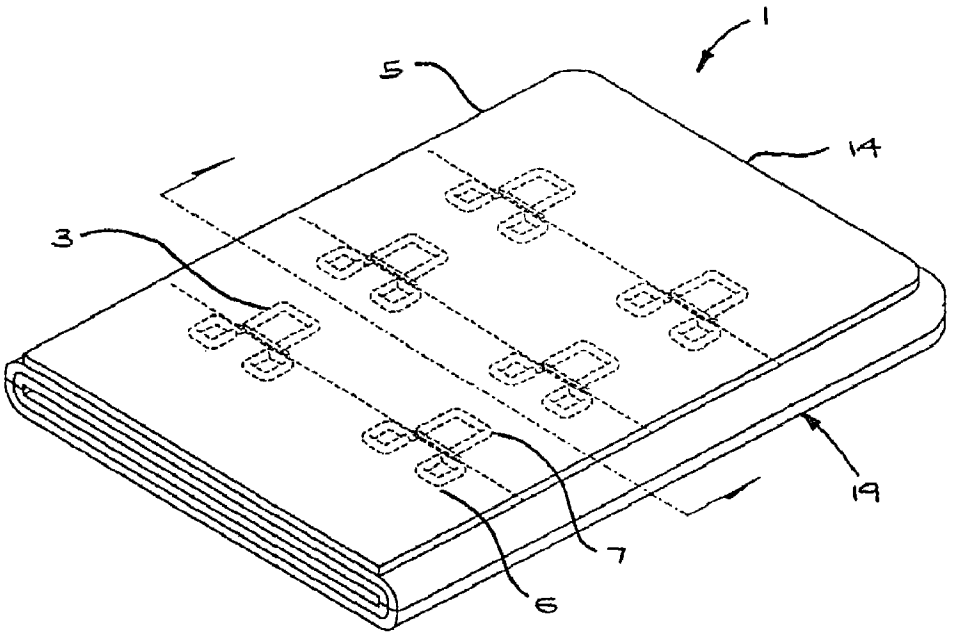
FIG. 6*a* is a schematic perspective illustration of a connector with the eye fasteners inserted into the apertures of the cover member.
Figure 6B:
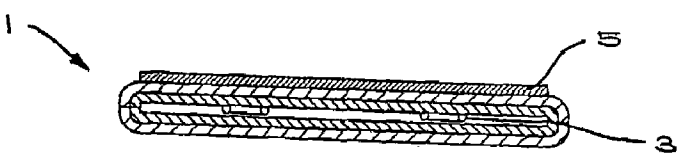
FIG. 6*b* is a schematic cross-sectional view of the connector with the eye fasteners inserted into the apertures of the cover member.

The accompanying drawings depict the steps in manufacturing a connector 1 having fasteners such as hooks 2 and eyes 3 arranged in an array. Although a method of manufacturing a connector 1 having fasteners such as hooks 2 and eyes 3 is illustrated it should be appreciated that this invention extends to other types of two component male or female fasteners.

Referring to the FIG. 1-6 there is depicted an elongate tape of backing sheet 4. A plurality of eyes 3 are sewn on the face of backing sheet 42 in an array comprising three longitudinal rows, within which they are aligned in transverse columns. Each eye 3 is formed of wire in a planar shape, comprising a pair of rings at its inner end 6 joined by a C-shape portion at its outer end 7. The eyes 3 are sewn to the backing sheet 5 proximate the inner end 6. The continuous tape of backing sheet 4 is cut transversely by a cutter vibrated ultrasonically at intervals to form individual backing sheet 5. In the preferred embodiment, each backing sheet 5 contains an array of six eyes 3. The eyes 3 are arranged in a form of three parallel rows each with two eyes 3 parallel to each other. The eyes 3 are uniformly spaced and are aligned in the same orientation.

According to the invention, a first and second layer 44, 45 is thermally bonded to form a one layered tape 9. The tape 9 is folded along its length resulting in a double layered tape 10 with only half the width of the original tape. The folded tape 10 is cut transversely at intervals to form individual cover sheet 11. The cover sheet 11 comprises a first sheet portion 12 and a second sheet portion 13. Each sheet portion 12, 13 have two sets of opposing ends 15, 16, 17, 18. The first and second sheet portions 12, 13 are parts of one sheet joined by a fold 14 elongated transverse to the opposing edges 15, 16, 17, 18 to produce a pocket 19. The joining of the opposing edges 15, 16, 17, 18 of the cover sheet 11 is by ultrasonic welding and the segmentation of the folded tape 10 is performed by a cutter vibrated ultrasonically. The welding of the opposing edges 15, 16, 17, 18 and the segmentation of the folded tape 10 are carried out simultaneously. One or more of the at least two opposing edges are joined by thermal bonding. The first sheet portion 12 comprises of a first and a second surfaces 20, 21 opposing each other. The two surfaces 20, 21 are thermally bonded.

Arrays of apertures 8 are punched along the length of a continuous tape of bonded tape 9 by a cutter ultrasonically vibrated. The apertures 8 are formed for receiving each eye 2. Each aperture 8 extends between opposing first and second surfaces 20, 21 of the first sheet portion 12.

Preferably, each first sheet portion 12 contains an array of six apertures 8. The six apertures 8 are arranged in three parallel rows each having two apertures sitting parallel to one another. The rows are uniformly spaced and the number of apertures 8 corresponds to the number of eyes 3 on the backing sheet 5. The orientation of each aperture 8 also corresponds to the orientation of the eyes 3 on the backing sheet 5.

The eyes 3 on a face of the backing sheet 42 are provided in rows for inserting into the corresponding rows of apertures 8 on the pocket 19. During the insertion, each eye 3 on the backing sheet 5 is inserted into a respective aperture 8 such that the face of the backing sheet 42 is directed inwardly to lie against the first surface 20. The second sheet portion 13 is abutted against the second surface 21. The backing sheet 5 is folded away from the outer end 7 so that the outer end 7 is allowed to be inserted into the aperture 8 easily. The face of the backing sheet 42 is directed inwardly to lie against the first surface 20. The backing sheet 5 is then fixed to the first or second sheet portion 12, 13. In the preferred embodiment, the backing sheet 5 is thermally bonded to the first surface 20 of the first sheet portion 12. The first surface 20 is Elastomeric polyurethane and the first and second sheet portions 12, 13 are made from fabric. The first and second sheet portions 12, 13 are inverted such that the face of the backing sheet 42 is directed outwardly with each eye 3 protrudes outwardly from each aperture 8 and the backing sheet 5 lies between the first and the second sheet portion 12, 13. The eyes 3 are substantially planar.

In another preferred embodiment, the first and second sheet portions 12, 13 are parts of different sheets and are joined only at the opposing edges 15, 16, 17, 18. The joining of the opposing edges 15, 16, 17, 18 of the cover sheet 11 is by ultrasonic welding. After the insertion of the eyes 3 on the backing sheet 5, the first and second sheet portions 12, 13 are inverted such that the face of the backing sheet 42 is directed outwardly with each eye 3 protrudes outwardly from each aperture 8 and the backing sheet 5 lies between the first and the second sheet portion 12, 13. The eyes 3 are substantially planar.

Referring to the FIG. 8-11 there is depicted an elongate tape of backing sheet 24. A plurality of hooks 2 are sewn on the face of backing sheet 43 in an array comprising one transverse column of two hooks. Each hook 2 is formed of wire in a planar shape, comprising a pair of rings at its inner end 26 joined by a C-shape portion at its outer end 27. The hooks 2 are sewn to the backing sheet 25 proximate the inner end 26. The continuous tape of backing sheet 24 is cut transversely by a cutter vibrated ultrasonically at intervals to form individual backing sheet 25. In the preferred embodiment, each backing sheet 25 contains an array of two hooks 2. The hooks 2 are arranged in a form of one row with two hooks parallel to each other. The hooks 2 are uniformly spaced and are aligned in the same orientation.

According to the invention, a first and second layer 46, 47 is thermally bonded to form a one layered tape 29. The tape 29 is folded along its length resulting in a double layered tape 30 with only half the width of the original tape. The folded tape 30 is cut transversely at intervals to form individual cover sheet 31. The cover sheet 31 comprises a first sheet portion 32 and a second sheet portion 33. Each sheet portion 32, 33 have two sets of opposing ends 34, 35, 36, 37. The first and second sheet portions 32, 33 are parts of one sheet joined by a fold 38 elongated transverse to the opposing edges 34, 35, 36, 37 to produce a pocket 39. The joining of the opposing edges 34, 35, 36, 37 of the cover sheet 31 is by ultrasonic welding and the segmentation of the folded tape 30 is performed by a cutter vibrated ultrasonically. The welding of the opposing edges 34, 35, 36, 37 and the segmentation of the folded tape 30 are carried out simultaneously. One or more of the at least two opposing edges are joined by thermal bonding. The first sheet portion 32 comprises of a first and a second surfaces 40, 41 opposing each other. The two surfaces 40, 41 are thermally bonded.

Arrays of apertures 28 are punched along the length of a continuous tape of bonded tape 29 by a cutter ultrasonically vibrated. The apertures 28 are formed for receiving each hook 2. Each aperture 28 extends between opposing first and second surfaces 40, 41 of the first sheet portion 32.

Preferably, each first sheet portion 32 contains an array of two apertures 28. The two apertures 28 are arranged in parallel row each and sitting parallel to one another. The number of apertures 28 corresponds to the number of hooks 2 on the backing sheet 5. The orientation of each aperture 28 also corresponds to the orientation of the hooks 2 on the backing sheet 25.

The hooks 2 on a face of the backing sheet 43 are provided in a row for inserting into the corresponding row of apertures 28 on the pocket 39. During the insertion, each hook 2 on the backing sheet 25 is inserted into a respective aperture 28 such that the face of the backing sheet 43 is directed inwardly to lie against the first surface 40. The second sheet portion 23 is abutted against the second surface 41. The backing sheet 25 is folded away from the outer end 27 so that the outer end 27 is allowed to be inserted into the aperture 28 easily. The face of the backing sheet 43 is directed inwardly to lie against the first surface 40. The backing sheet 25 is then fixed to the first or second sheet portion 32, 33. In the preferred embodiment, the backing sheet 25 is thermally bonded to the first surface 40 of the first sheet portion 32. The first surface 40 is Elastomeric polyurethane and the first and second sheet portions 32, 33 are made from fabric. The first and second sheet portions 32, 33 are inverted such that the face of the backing sheet 43 is directed outwardly with each hook 2 protrudes outwardly from each aperture 28 and the backing sheet 25 lies between the first and the second sheet portion 32, 33.

In another preferred embodiment, the first and second sheet portions 32, 33 are parts of different sheets and are joined only at the opposing edges 34, 35, 36, 37. The joining of the opposing edges 34, 35, 36, 37 of the cover sheet 31 is by ultrasonic welding. After the insertion of the hooks 2 on the backing sheet 25, the first and second sheet portions 32, 33 are inverted such that the face of the backing sheet 43 is directed outwardly with each hook 2 protrudes outwardly from each aperture 28 and the backing sheet 25 lies between the first and the second sheet portion 32, 43.

The steps for manufacturing the connectors 1 may be in any order.

FIGS. 7*a*, 7*b*, 12*a* and 12*b* discloses connectors 1 manufactured by the method disclosed in FIGS. 1-6 and FIGS. 8-11.

Figure 7A:
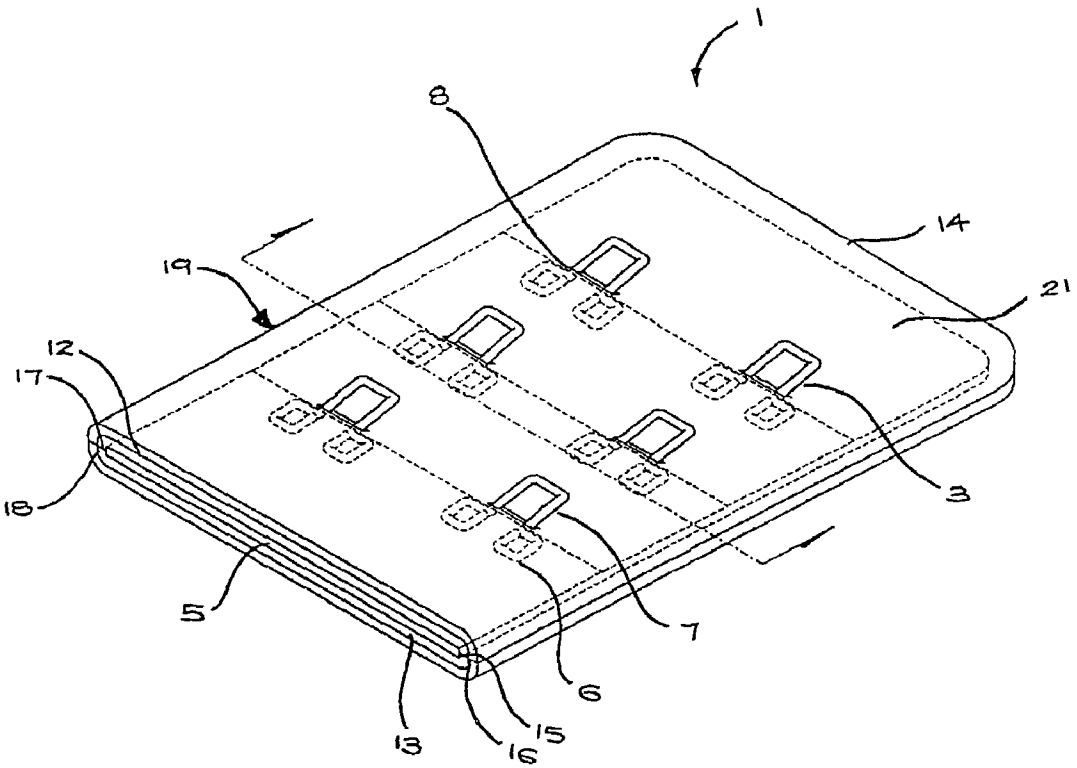
FIG. 7*a* is a schematic perspective illustration of the connector turned inside-out exposing outer ends of the eye fasteners.
Figure 7B:
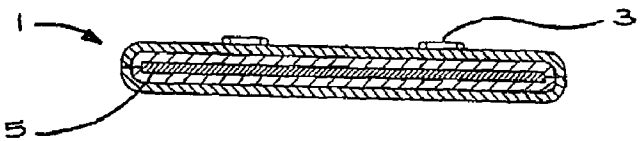
FIG. 7*b* is a schematic cross-sectional view of the connector turned inside-out exposing the outer ends of the eye fasteners.
Figure 8:
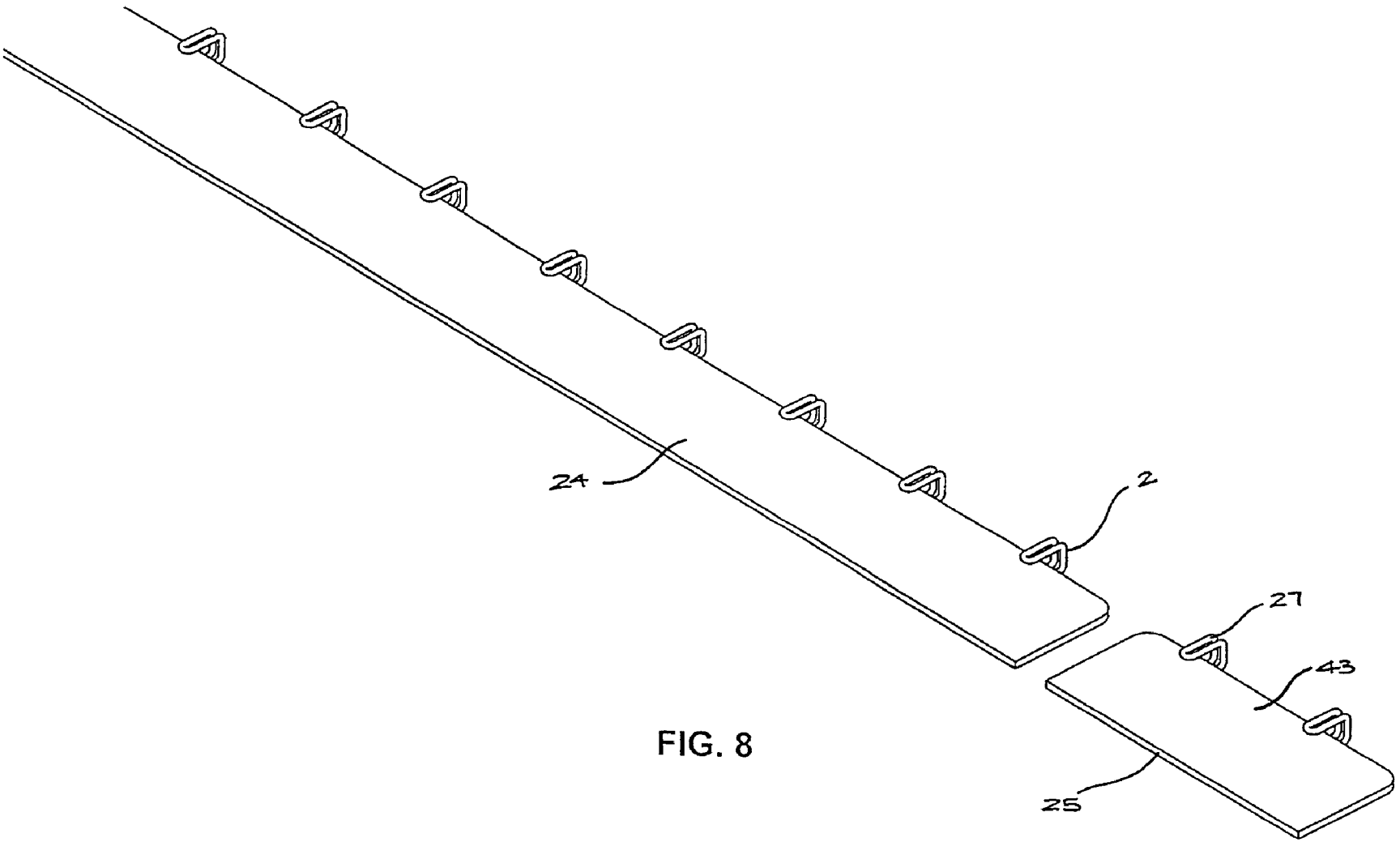
FIG. 8 is a schematic perspective illustration of a continuous tape of backing sheet with arrays of hook fasteners.
Figures 9A, 9B:
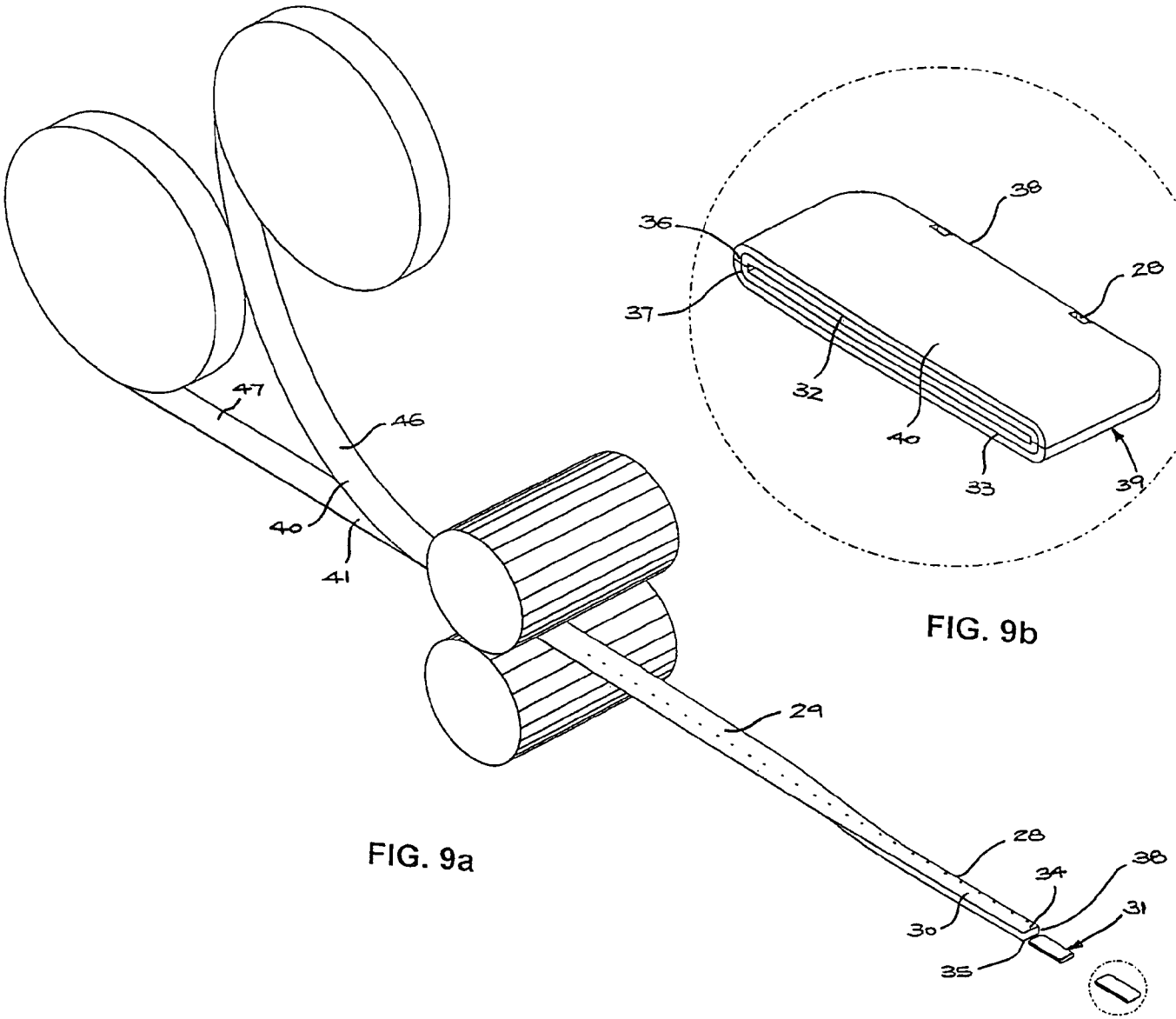
FIG. 9*a* is a schematic illustration of laminating a first surface with a second surface to form a first sheet portion of a cover member for hook fasteners.
FIG. 9*b* is an enlarged schematic perspective illustration of part X in FIG. 9*a*.
Figure 10:
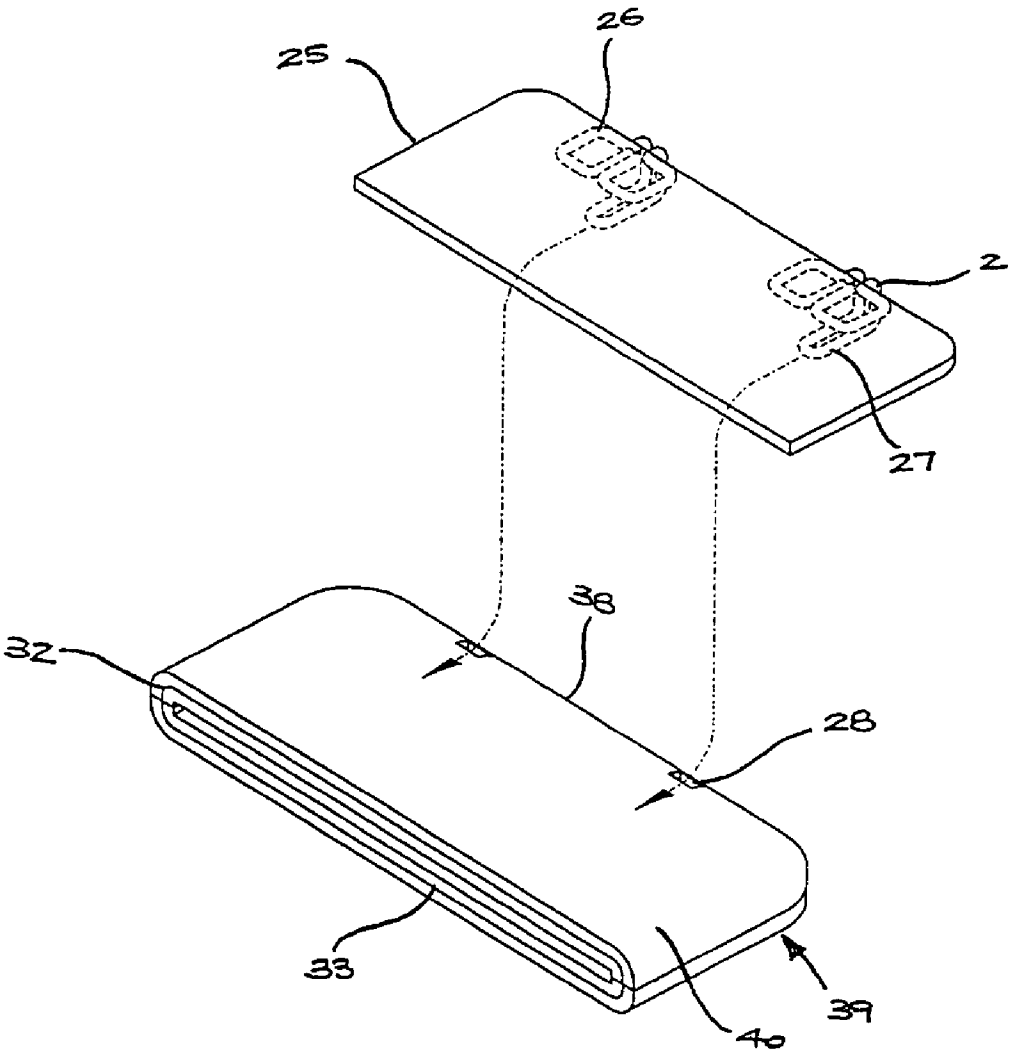
FIG. 10 is a schematic perspective illustration of inserting the hook fasteners on a backing sheet into apertures of the cover member.
Figure 11A:
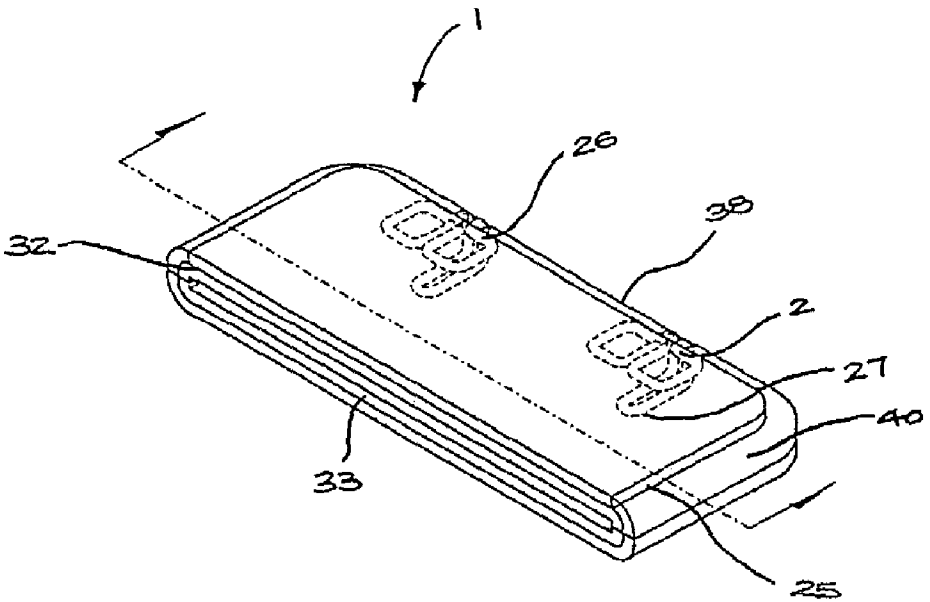
FIG. 11*a* is a schematic illustration of a connector with the hook fasteners inserted into the apertures of the cover member.
Figure 11B:
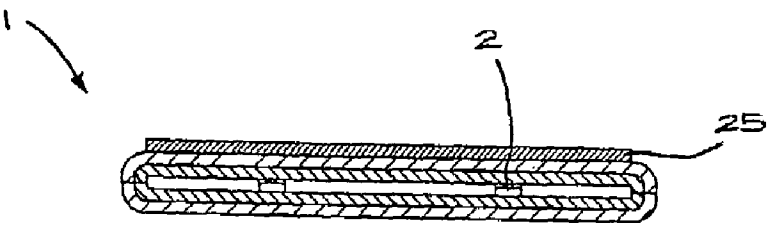
FIG. 11*b* is a schematic cross-sectional view of the connector with the hook fasteners inserted into the apertures of the cover member.

A further aspect of the invention is depicted in FIG. 7*a* and 7*b*. According to the figures, there is depicted a connector 1 mainly for clothing or textile item which generally comprises of a backing sheet 5 and a plurality of eye 3 fasteners fixed in a first array to the backing sheet 5. First and second sheet portions 12, 13 of a cover member 11 are joined along at least two opposing edges 15, 16 or 17, 18 common to both the first and second sheet portions 12, 13. The first sheet portion 12 including a second array of apertures 8, at least one of the first and second sheet portions 12, 13 is fixed to the backing sheet 5. The backing sheet 5 lies between the first and second sheet portions 12, 13 and each eye 3 projects from a respective one of the aperture 8.

Figure 12A:
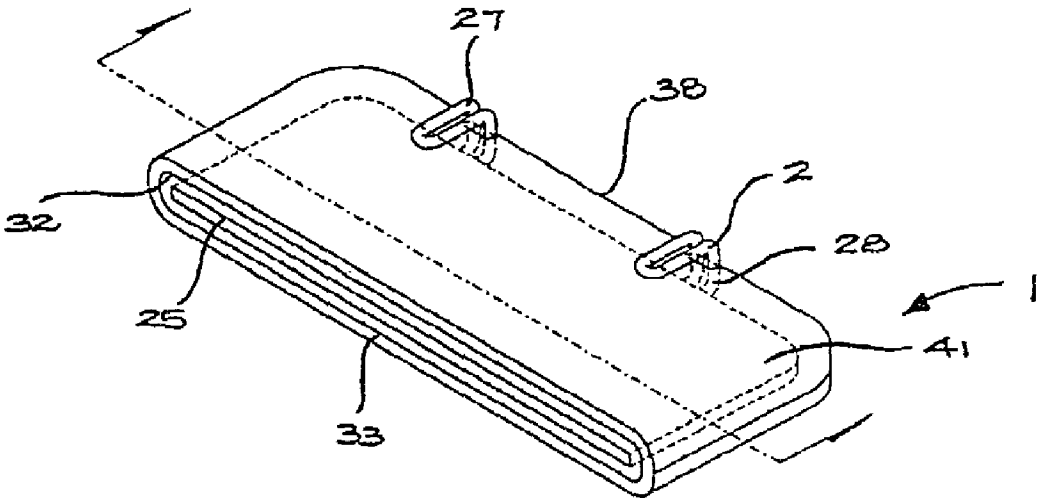
FIG. 12*a* is a schematic perspective illustration of the connector turned inside-out exposing outer end of the hook fastener.
Figure 12B:
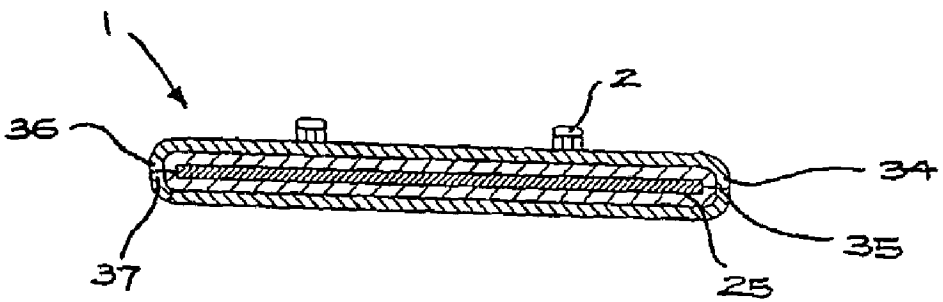
FIG. 12*b* is a schematic cross-sectional view of the connector turned inside-out exposing the outer end of the hook fastener.

A further aspect of the invention is depicted in FIG. 12*a* and 12*b*. According to the figures, there is depicted a connector 1 mainly for clothing or textile item which generally comprises of a backing sheet 25 and a plurality of hook fasteners 2 fixed in a first array to the backing sheet 25. First and second sheet portions 32, 33 of a cover member 31 are joined along at least two opposing edges 34, 35 or 36, 37 common to both the first and second sheet portions 32, 33. The first sheet portion 32 including a second array of apertures 28, at least one of the first and second sheet portions 32, 33 is fixed to the backing sheet 25. The backing sheet 25 lies between the first and second sheet portions 32, 33 and each hook 2 projects from a respective one of the aperture 28.

It should be appreciated that modifications and alterations obvious to those skilled in the art are not to be considered as beyond the scope of the present invention. For example, in the preferred manufacturing process the backing sheet is bonded to the second surface of the first surface portion of the cover member before inverting the first and second sheet portions.

In an alternative embodiment, the lamination can be taken placed after the inverting of the first and the second sheet portions.

In the preferred embodiment, there are a preferred number of hooks and eyes. In an alternative embodiment, the number of hooks and eyes may be varied.

In the preferred embodiment, the first surface of first sheet portion is elastomeric polyurethane. In an alternative embodiment, the first surface can be made of any other materials.

In the preferred embodiment, a plurality of fasteners in an array is fastened on the face of a backing sheet. In an alternative embodiment, a single fastener may be fastened on the face of the backing sheet.

What is claimed is:

1. A method of manufacturing a connector having fasteners, such as hooks or eyes for a hook-and-eye connector, comprising the steps:

a) fastening a plurality of the fasteners in an array on a face of a backing sheet;

b) forming an aperture in a first sheet portion for receiving each fastener, each aperture extending between opposing first and second surfaces of the first sheet portion;

c) inserting each fastener into a respective aperture such that the face of the backing sheet is directed inwardly to lie against the first surface;

d) abutting a second sheet portion with the second surface and joining the first and second sheet portions such that they are joined along at least two opposing edges common to both the first and second sheet portions;

e) fixing the backing sheet to the first or second sheet portion;

f) inverting the first and second sheet portions such that the face of the backing sheet is directed outwardly, each fastener protrudes outwardly from each aperture and the backing sheet lies between the first and second sheet portions.

2. The method of claim 1 wherein the first and second sheet portions are parts of one sheet joined by a fold elongated transverse to the opposing edges to form a pocket.

3. The method of claim 1 wherein each fastener was an outer end inserted through the aperture and an inner end fixed to the backing sheet, and wherein at step c) the backing sheet is folded away from the outer end such that the outer end projects from the backing sheet before being inserted into the aperture.

4. The method of claim 1 wherein one or more of the at least two opposing edges are joined by thermal bonding.

5. The method of claim 1 wherein one or more of the at least two opposing edges are joined by ultrasonic welding.

6. The method of claim 1 wherein the apertures are formed into first sheet portion by a cutter that vibrates ultrasonically.

7. The method of claim 1 wherein the first and second sheet portions are made from fabric.

8. The method of claim 1 wherein the first and the second surfaces are thermally bonded.

9. The method of claim 1 wherein the first sheet portion is made from Elastomeric polyurethane.

10. The method of claim 1 wherein the plurality of the fasteners is sewn on the face of a continuous strip of backing sheet.

11. The method of claim 10 wherein the continuous strip of backing sheet having fasteners is segmented at intervals by a cutter ultrasonically vibrated to form individual backing sheet.

12. The method of claim 1 wherein the connector is a hook.

13. The method of claim 1 wherein the connector is a eye.

* * * * *